US006951589B2

(12) United States Patent
Pollack et al.

(10) Patent No.: US 6,951,589 B2
(45) Date of Patent: Oct. 4, 2005

(54) WATER IN OIL EXPLOSIVE EMULSIONS

(75) Inventors: Robert A. Pollack, Highland Heights, OH (US); John J. Mullay, Mentor, OH (US); Brian B. Filippini, Mentor-on-the-Lake, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/181,661

(22) PCT Filed: Jan. 23, 2001

(86) PCT No.: PCT/US01/02181

§ 371 (c)(1),
(2), (4) Date: Jul. 19, 2002

(87) PCT Pub. No.: WO01/55058

PCT Pub. Date: Aug. 2, 2001

(65) Prior Publication Data

US 2003/0019552 A1 Jan. 30, 2003

Related U.S. Application Data

(60) Provisional application No. 60/177,961, filed on Jan. 25, 2000.

(51) Int. Cl.[7] ..... C06B 45/00; C06B 31/28
(52) U.S. Cl. ..... 149/2; 149/46
(58) Field of Search ..... 149/2, 46

(56) References Cited

U.S. PATENT DOCUMENTS

| | | | | |
|---|---|---|---|---|
| 4,294,633 A | * | 10/1981 | Clay | 149/2 |
| 4,619,721 A | * | 10/1986 | Cescon et al. | 149/46 |
| 4,708,753 A | | 11/1987 | Forsberg | 149/2 |
| 4,931,110 A | | 6/1990 | McKenzie et al. | 149/2 |
| 4,999,062 A | | 3/1991 | Snare et al. | 149/2 |
| 5,034,071 A | | 7/1991 | VanOmmeren | 149/7 |
| 5,076,867 A | | 12/1991 | McKenzie | 149/2 |
| 5,123,981 A | * | 6/1992 | Mullay et al. | 149/7 |
| 5,409,556 A | * | 4/1995 | Lownds | 149/2 |
| 5,454,890 A | | 10/1995 | Evans et al. | 149/46 |
| 5,920,031 A | | 7/1999 | Jahnke | 149/2 |

FOREIGN PATENT DOCUMENTS

| | | | |
|---|---|---|---|
| EP | 320 182 A | 6/1989 | C05G/47/14 |
| EP | 330 375 A | 8/1989 | C06B/47/14 |
| EP | 331 306 A | 9/1989 | C06B/47/14 |
| EP | 360 394 A | 3/1990 | C06B/47/14 |
| EP | 561 600 A | 9/1993 | C06B/47/14 |
| EP | 771 740 A | 5/1996 | C06B/3/00 |

OTHER PUBLICATIONS

Chemical Abstract, vol. 122. No. 10 (Mar. 6, 1955).
European Search Report, PCT/US 01/02181 published under WO 011/55058 A2.

* cited by examiner

*Primary Examiner*—Aileen Felton
(74) *Attorney, Agent, or Firm*—Samuel B. Laferty; Michael F. Esposito

(57) ABSTRACT

Water-in-oil emulsion explosive compositions comprising a) an aqueous oxidizer phase comprising at least one oxygen supplying component wherein said oxygen supplying component comprises at least 50% by weight of prilled agricultural grade ammonium nitrate, b) an organic phase, comprising at least one organic fuel and c) an emulsifying amount of an aliphatic hydrocarbyl group substituted succinic emulsifier composition, said succinic emulsifier composition having at least one of succinic ester groups, succinic amide groups, succinic imine groups, succinic ester-amide and succinimide groups, and mixtures thereof, wherein each of said groups is substituted with an aminoalkyl group, wherein the aliphatic hydrocarbon based group contains from about 18 up to about 500 carbon atoms.

20 Claims, No Drawings

WATER IN OIL EXPLOSIVE EMULSIONS

This application claims the benefit of Provisional Application No. 60/177,961, filed Jan. 25, 2000.

TECHNICAL FIELD

This invention relates to water-in-oil explosive emulsions containing at least one succinic emulsifier composition, an organic fuel and prilled agricultural grade ammonium nitrate.

BACKGROUND OF THE INVENTION

Hydrocarbyl-substituted carboxylic acylating agents having at least about 30 aliphatic carbon atoms in the substituent are known. Examples of such acylating agents include the polyisobutenyl-substituted succinic acids and anhydrides. The use of such carboxylic acylating agents as additives in normally liquid fuels and lubricants is disclosed in U.S. Pat. Nos. 3,288,714 and 3,346,354. These acylating agents are also useful as intermediates for preparing additives for use in normally liquid fuels and lubricants as described in U.S. Pat. Nos. 2,892,786; 3,087,936; 3,163,603; 3,172,892; 3,189,544; 3,215,707; 3,219,666; 3,231,587; 3,235,503; 3,272,746; 3,306,907; 3,306,908; 3,331,776; 3,341,542; 3,346,354; 3,374,174; 3,379,515; 3,381,022; 3,413,104; 3,450,715; 3,454,607; 3,455,728; 3,476,686; 3,513,095; 3,523,768; 3,630,904; 3,632,511; 3,697,428; 3,755,169; 3,804,763; 3,836,470; 3,862,981; 3,936,480; 3,948,909; 3,950,341; and 4,471,091; and French Patent 2,223,415.

U.S. Pat. No. 4,234,435 discloses carboxylic acid acylating agents derived from polyalkenes such as polybutenes, and a dibasic carboxylic reactant such as maleic or fumaric acid or certain derivatives thereof. These acylating agents are characterized in that the polyalkenes from which they are derived have an $\overline{M}_n$ value of about 1300 to about 5000 and an $\overline{M}_w/\overline{M}_n$ value of about 1.5 to about 4. The acylating agents are further characterized by the presence within their structure of at least 1.3 groups derived from the dibasic carboxylic reactant for each equivalent weight of the groups derived from the polyalkene. The acylating agents can be reacted with an amine to produce derivatives useful per se as lubricant additives or as intermediates to be subjected to post-treatment with various other chemical compounds and compositions, such as epoxides, to produce still other derivatives useful as lubricant additives.

Water-in-oil explosive emulsions typically comprise a continuous organic phase (e.g., a carbonaceous fuel) and a discontinuous aqueous phase containing an oxygen-supplying component (e.g., ammonium nitrate). Examples of such water-in-oil explosive emulsions are disclosed in U.S. Pat. Nos. 3,447,978; 3,765,964; 3,985,593; 4,008,110; 4,097,316; 4,104,092; 4,218,272; 4,259,977; 4,357,184; 4,371,408; 4,391,659; 4,404,050; 4,409,044; 4,448,619; 4,453,989; and 4,534,809; and U.K. Patent Application GB 2,050,340A.

U.S. Pat. No. 4,216,040 discloses water-in-oil emulsion blasting agents having a discontinuous aqueous phase, a continuous oil or water-immiscible liquid organic phase, and an organic cationic emulsifier having a lipophilic portion and a hydrophilic portion, the lipophilic portion being an unsaturated hydrocarbon chain.

U.S. Pat. Nos. 4,708,753 and 4,844,756 disclose water-in-oil emulsions which comprise (A) a continuous oil phase; (B) a discontinuous aqueous phase; (C) a minor emulsifying amount of at least one salt derived from (C)(I) at least one hydrocarbyl-substituted carboxylic acid or anhydride, or ester or amide derivative of said acid or anhydride, the hydrocarbyl substituent of (C)(I) having an average of from about 18 to about 500 carbon atoms, and (C)(II) ammonia or at least one amine; and (D) a functional amount of at least one water-soluble, oil-insoluble functional additive dissolved in said aqueous phase. The '756 patent discloses that component (C)(II) can also be an alkali or alkaline-earth metal. These emulsions are useful as explosive emulsions when the functional additive (D) is an oxygen-supplying component (e.g., ammonium nitrate).

U.S. Pat. No. 4,710,248 discloses an emulsion explosive composition comprising a discontinuous oxidizer-phase dispersed throughout a continuous fuel phase with a modifier comprising a hydrophilic moiety and a lipophilic moiety. The hydrophilic moiety comprises a carboxylic acid or a group capable of hydrolyzing to a carboxylic acid. The lipophilic moiety is a saturated or unsaturated hydrocarbon chain. The emulsion explosive composition pH is above 4.5.

U.S. Pat. No. 4,822,433 discloses an explosive emulsion composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at 60° C., not exceeding 60,000 picomhos/meter. The reference indicates that the conductivity may be achieved by the inclusion of a modifier which also functions as an emulsifier. The modifier is comprised of a hydrophilic moiety and a lipophilic moiety. The lipophilic moiety can be derived from a poly[alk(en)yl] succinic anhydride. Poly(isobutylene) succinic anhydride having a number average molecular weight in the range of 400 to 5000 is specifically identified as being useful. The hydrophilic moiety is described as being polar in character, having a molecular weight not exceeding 450 and can be derived from polyols, amines, amides, alkanol amines and heterocyclics. Example 14 of this reference discloses the use of a 1:1 condensate of polyisobutenyl succinic anhydride (number average molecular weight=1200) and dimethylethanol amine as the modifier/emulsifier.

U.S. Pat. No. 4,828,633 discloses salt compositions which comprise (A) at least one salt moiety derived from (A)(I) at least one high-molecular weight polycarboxylic acylating agent, said acylating agent (A)(I) having at least one hydrocarbyl substituent having an average of from about 18 to about 500 carbon atoms, and (A)(II) ammonia, at least one amine, at least one alkali or alkaline earth metal, and/or at least one alkali or alkaline earth metal compound; (B) at least one salt moiety derived from (B)(I) at least one low-molecular weight polycarboxylic acylating agent, said acylating agent (B)(I) optionally having at least one hydrocarbyl substituent having an average of up to about 18 carbon atoms, and (B)(II) ammonia, at least one amine, at least one alkali or alkaline earth metal, and/or at least one alkali or alkaline earth metal compound; said components (A) and (B) being coupled together by (C) at least one compound having (i) two or more primary amino groups, (ii) two or more secondary amino groups, (iii) at least one primary amino group and at least one secondary amino group, (iv) at least two hydroxyl groups or (v) at least one primary or secondary amino group and at least one hydroxyl group. These salt compositions are useful as emulsifiers in water-in-oil explosive emulsions.

U.S. Pat. Nos. 4,840,687 and 4,956,028 disclose explosive compositions comprising a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent, (B) at least one polyamine, and (C) at least one acid or acid-producing compound capable of forming at least one salt with said polyamine. Examples of (A) include polyisobutenyl succinic acid or anhydride. Examples of (B) include the alkylene polyamines. Examples of (C) include the phosphorus acids (e.g., O,S-dialkylphosphorotrithioic acid). These explosive compositions can be water-in-oil emulsions or melt-in-oil emulsions.

U.S. Pat. No. 4,863,534 discloses an explosive composition comprising a discontinuous oxidizer phase comprising at least one oxygen-supplying component, a continuous organic phase comprising at least carbonaceous fuel, and an emulsifying amount of (A) at least one salt composition derived from (A)(1) at least one high-molecular weight hydrocarbyl-substituted carboxylic acid or anhydride, or ester or amide derivative of said acid or anhydride, the hydrocarbyl substituent of (A)(1) having an average of from about 18 to about 500 carbon atoms, and (A)(2) ammonia, at least one amine, at least one alkali or alkaline earth metal compound; and (B) at least one salt composition derived from (B)(1) at least one low-molecular weight hydrocarbyl-substituted carboxylic acid or anhydride, or ester or amide derivative of said acid or anhydride, the hydrocarbyl substituent of (B)(1) having an average of from about 8 to about 18 carbon atoms, and (B)(2) ammonia, at least one amine, at least one alkali or alkaline earth metal, and/or at least one alkali or alkaline earth metal compound.

U.S. Pat. No. 4,919,178 discloses emulsifiers which comprise the reaction product of component (I) with component (II). Component (I) comprises the reaction product of certain carboxylic acids or anhydrides, or ester or amide derivatives thereof, with ammonia, at least one amine, at least one alkali and/or at least one alkaline-earth metal. Component (II) comprises certain phosphorous-containing acids; or metal salts of said phosphorous-containing acids, the metals being selected from the group consisting of magnesium, calcium, strontium, chromium, manganese, iron, molybdenum, cobalt, nickel, copper, silver, zinc, cadmium, aluminum, tin, lead, and mixtures of two or more thereof. These emulsifiers are useful in water-in-oil explosive emulsions.

U.S. Pat. No. 4,931,110 relates to water in oil emulsion explosive compositions employing bis(alkanolamine or polyol) amide and/or ester derivatives of bis-carboxylated or anhydride derivatized addition polymers as emulsifier.

U.S. Pat. No. 4,956,028 discloses an explosive composition which comprises a discontinuous oxidizer phase comprising at least one oxygen-supplying component, a continuous organic phase comprising at least one water-immiscible organic liquid, and an emulsifying amount of at least one nitrogen-containing emulsifier derived from (A) at least one carboxylic acylating agent (B) at least one polyamine, and (C) at least one acid or acid-producing compound capable of forming at least one salt with said polyamine. These explosive compositions can be water-in-oil emulsions or melt-in-oil emulsions.

U.S. Pat. No. 4,999,062 describes an emulsion explosive composition comprising a discontinuous phase comprising an oxygen-releasing salt, a continuous water-immiscible organic phase and an emulsifier component comprising a condensation product of a primary amine and a poly[alk(en)yl]succinic acid or anhydride and wherein the condensation product comprises at least 70% by weight succinimide product.

European Patent application EP 561,600 A discloses a water-in-oil emulsion explosive in which the emulsifier is the reaction product of a substituted succinic acylating agent, having at least 1.3 succinic groups per equivalent weight of substituents, with ammonia and/or an amine. The substituent is a polyalkene having number average molecular weight of greater than 500 and preferably 1300–1500.

U.S. Pat. No. 4,919,179 discloses a water-in-oil emulsion explosive wherein the emulsifier is a particular type of ester of polyisobutenyl succinic anhydride.

U.S. Pat. No. 4,844,756 discloses a water-in-oil emulsion explosive wherein the emulsifier is a salt produced by reacting a hydrocarbyl substituted carboxylic acid or anhydride, including substituted succinic acids and anhydrides, with ammonia, an amine, and/or an alkali or alkaline earth metal.

U.S. Pat. No. 4,818,309 discloses a water-in-oil emulsion explosive wherein the emulsifier is a polyalkenyl succinic acid or derivative thereof. The succinic acid may be used in the form of an anhydride, an ester, an amide or an imide. A condensate with ethanolamine is preferred.

U.S. Pat. No. 4,708,753 discloses a water-in-oil emulsion suitable for use in explosive and functional fluids wherein the emulsifier is a reaction product of a hydrocarbyl substituted carboxylic acid, including a succinic acid, with an amine. The substituent contains 18–500 carbon atoms, and the aqueous phase contains a water soluble, oil insoluble functional additive.

European Patent EP 102,827 A discloses a water-in-oil emulsion composition useful as a well control fluid. The emulsifier is a polyamine derivative, especially an alkylene polyamine derivative, of a polyisobutenyl succinic anhydride or a borated or carboxylated derivative thereof.

U.S. Pat. No. 4,445,576 discloses a water-in-oil emulsion composition useful as a spacer fluid in well drilling. The emulsifier is an amine derivative, especially a polyamine derivative, of a polyalkenyl succinic anhydride.

U.S. Pat. No. 4,999,062 describes an emulsion explosive composition comprising a discontinuous phase comprising an oxygen-releasing salt, a continuous water-immiscible organic phase and an emulsifier component comprising a condensation product of a primary amine and a poly[alk(en)yl]succinic acid or anhydride and wherein the condensation product comprises at least 70% by weight succinimide product.

United States defensive publication T969,003 discloses water in oil emulsion fertilizer compositions prepared by dissolving an invert emulsifier in an oil such as kerosene. A liquid (aqueous) fertilizer is emulsified with the oil to form an invert emulsifier.

Patent application WO 96/28436 describes gamma and delta lactones of formulae (I) and (II)

(I)

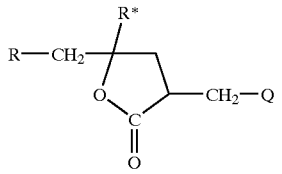

-continued (II)

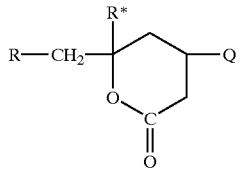

used as emulsifiers in explosive compositions comprising a continuous organic phase and a discontinuous aqueous phase containing an oxygen-supplying compound. In the formulae, R is hydrocarbyl, R* is hydrogen, methyl or another hydrocarbyl, and Q is an amide, ammonium salt or ester functionality.

Patent Application WO 00/17130 relates to a water-in-oil emulsion explosive composition comprising an aqueous oxygen-supplying salt solution and anti-caking and stabilizing agents as the discontinuous phase, and a continuous water-immiscible organic phase including an emulsifying agent, an emulsifier selected from the group consisting of poly(isobutylene) succinic anhydride or poly(isobutylene) succinic acid which has been derivatised with amine or alkanolamine.

U.S. Pat. No. 5,920,031 is directed to water in oil emulsions which are useful as explosives. The emulsions comprise a discontinuous aqueous phase, comprising at least on oxygen-supplying component, a continuous organic phase comprising at least one carbonaceous fuel and a minor emulsifying amount of at least one emulsifier made by reaction of at least one substituted succinic acylating agent consisting of substituent groups and succinic groups said acylating agents being characterized by the presence within their structure of an average of at least 1.3 succinic groups for each equivalent weight of substituent groups, with ammonia and/or at least one monoamine. These emulsions may be blended with ammonium nitrate prills including those made with crystal habit modifiers.

Commercial emulsion explosive compositions utilize ammonium nitrate, usually as a solution in water, as the main oxidizing material. The ammonium nitrate used to prepare the aqueous solution can come from a variety of sources. In some locations, relatively pure ammonium nitrate solution is not available. In this case, prilled material has been used. The prilled material is usually an agricultural grade ammonium nitrate containing crystal habit modifiers to control crystal growth and one or more surfactants to reduce caking.

The prilled agricultural grade ammonium nitrate includes these additives to improve processing in the manufacturing plants. Use of the additives permits manufacture of ammonium nitrate that is much less costly than explosive grade ammonium nitrate. Thus, it is desirable to use prilled agricultural grade ammonium nitrate containing these additives. However, use of prilled ammonium nitrate, except in modest amounts, tends to destabilize an emulsion.

Water-in-oil explosive emulsions, already containing ammonium nitrate, are often blended with additional ammonium nitrate prills or preblended prilled ammonium nitrate-fuel oil (ANFO) mixtures for the purpose increasing the explosive energy of such emulsions. Among the commercially available ammonium nitrate prills that are used are those that are made using one or more crystal habit modifiers. When these are incorporated in modest amounts into preformed emulsion explosives, the emulsion generally remains stable over time.

A problem arises when these treated prills are used in larger amounts, often as the sole oxygen supplying component, either in the preparation of the emulsion or when further amounts are added to a preformed emulsion. Under these conditions, they tend to destabilize the resulting emulsions. Components of the emulsion separate. It would be advantageous to provide explosive emulsions that remain stable when prepared using such treated ammonium nitrate prills.

SUMMARY OF THE INVENTION

This invention is directed to water-in-oil emulsion explosive compositions comprising a) an aqueous oxidizer phase comprising at least one oxygen supplying component wherein said oxygen supplying component comprises at least 50% by weight of prilled agricultural grade ammonium nitrate, b) an organic phase comprising at least one organic fuel, and c) an emulsifying amount of an aliphatic hydrocarbyl substituted succinic emulsifier composition said succinic emulsifier composition having at least one of succinic ester groups, succinic amide groups, succinic imine groups, succinic ester-amide, and succinimide groups and mixtures thereof, wherein at least one of said groups is substituted with an aminoalkyl group, wherein the aliphatic hydrocarbon based group contains from about 18 up to about 500 carbon atoms,

DETAILED DESCRIPTION OF THE PREFERRED EMBODIMENTS

The term "emulsion" as used in this specification and in the appended claims is intended to cover not only water-in-oil emulsions, but also compositions derived from such emulsions wherein at temperatures below that at which the emulsion is formed the discontinuous phase is solid or in the form of droplets of super-cooled liquid. This term also covers compositions derived from or formulated as such water-in-oil emulsions that are in the form of gelatinous or semi-gelatinous compositions.

As used herein, the terms hydrocarbyl substituent, hydrocarbyl group, hydrocarbon group, and the like, are used to refer to a group having one or more carbon atoms directly attached to the remainder of a molecule and having a hydrocarbon or predominantly hydrocarbon character. Examples include:

(1) purely hydrocarbon groups, that is, aliphatic (e.g., alkyl, alkenyl or alkylene), alicyclic (e.g., cycloalkyl, cycloalkenyl) groups, aromatic groups, and aromatic-, aliphatic-, and alicyclic-substituted aromatic groups, as well as cyclic groups wherein the ring is completed through another portion of the molecule;

(2) substituted hydrocarbon groups, that is, hydrocarbon groups containing non-hydrocarbon groups which, in the context of this invention, do not alter the predominantly hydrocarbon nature of the group (e.g., halo, hydroxy, alkoxy, mercapto, alkylmercapto, nitro, nitroso, and sulfoxy);

(3) hetero substituted hydrocarbon groups, that is, hydrocarbon groups containing substituents which, while having a predominantly hydrocarbon character, in the context of this invention, contain other than carbon in a ring or chain otherwise composed of carbon atoms. Heteroatoms include sulfur, oxygen, nitrogen. In general, no more than two, and in one embodiment no more than one, non-hydrocarbon substituent is present for every ten carbon atoms in the hydrocarbon group.

In general, no more than about three nonhydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation. Ethylenic unsaturation, when present will generally be such that there is no more than one ethylenic linkage present for every ten carbon-to-carbon bonds. The hydrocarbyl groups are often completely saturated and therefore contain no ethylenic unsaturation.

The term "lower" as used herein in conjunction with terms such as hydrocarbyl, alkyl, alkenyl, alkoxy, and the like, is intended to describe such groups which contain a total of up to 7 carbon atoms.

The term "total acid number" (TAN) refers to a milligrams of potassium hydroxide (KOH) needed to neutralize all of the acidity in one gram of a product or a composition. The sample to be tested is dissolved in a toluene and tert-butyl alcohol solvent and titrated potentiometrically with a solution of tetra-n-butylammonium hydroxide. The toluene and tert-butyl alcohol solvent is prepared by diluting 100 ml of 25% methanolic tert-butyl alcohol and 200 ml of isopropyl alcohol to one liter total volume with toluene. The solution of tetra-n-butylammonium hydroxide is a 25% by weight solution in methyl alcohol. A Metrohm Standard pH Combination Glass Electrode EA 120 (3M aq. KCI), which is a combination glass-plus-reference electrode, is used. The end-points corresponding to the inflections are obtained from the titration curve and the acid numbers calculated.

The term "total base number" (TBN) refers to a measure of the amount of acid (perchloric or hydrochloric) needed to neutralize the basicity of a product or a composition, expressed as KOH equivalents. It is measured using Test Method ASTM D 2896.

Use of the expression "prilled" in reference to ammonium nitrate used in the explosive emulsions of this invention refers, unless indicated otherwise, to agricultural grade ammonium nitrate.

The Emulsions

The emulsifiers used in the present invention are particularly useful for preparing oil continuous phase emulsions, that is, water-in-oil emulsions in which there are high levels of active components in the dispersed aqueous phase.

The water-in-oil emulsions have the bulk characteristics of the continuous oil phase even though on a volume basis, the aqueous phase may be the predominant phase.

The inventive water-in-oil emulsion explosives comprise a discontinuous aqueous oxidizer phase, a continuous organic phase comprising at least one organic fuel, typically a carbonaceous fuel, and a minor emulsifying amount of at least one emulsifier.

The continuous organic phase is preferably present at a level of at least about 2% by weight, more preferably in the range of about 2% to about 10% by weight, more preferably in the range of about 3.5% to about 10%, more preferably about 5% to about 8% by weight based on the total weight of the water-in-oil emulsion. The discontinuous aqueous phase is preferably present at a level of at least about 90% by weight to about 98% by weight, preferably from about 92% to about 95% by weight based on the total weight of the emulsion. The emulsifier composition is preferably present at a level in the range of about 5% to about 95%, preferably about 5% to about 50%, often from about 4% to about 40%, more preferably about 5% to about 20%, and especially from about 10% to about 20% by weight based on the total weight of the organic phase. The oxygen-supplying component is preferably present at a level in the range of about 70% to about 95% by weight, preferably about 75% to about 92% by weight, more preferably about 78% to about 90% by weight based on the total weight of the aqueous phase. Water is preferably present at a level in the range of about 5% to about 30% by weight, more preferably about 8% to about 25% by weight, more preferably about 10% to about 20% by weight based on the weight of the aqueous phase.

The Organic Fuel Phase

The emulsion compositions of this invention comprise a continuous organic phase comprising at least one organic fuel.

The Fuel

The fuel that is useful in the emulsions of the invention is an organic fuel, typically a carbonaceous fuel, including most hydrocarbons, for example, paraffinic, olefinic, naphthenic, aromatic, saturated or unsaturated hydrocarbons, and is typically in the form of an oil or a wax or a mixture thereof. Carbonaceous fuels contain carbon and usually, hydrogen, and may contain other elements such as oxygen, silicon, etc. Oils from a variety of sources, including natural and synthetic oils and mixtures thereof can be used as the carbonaceous fuel. Most often, the carbonaceous fuel is a water-immiscible, emulsifiable hydrocarbon that is either liquid at about 20° C. or is liquefiable at a temperature below about 95° C., and preferably between about 40° C. and about 75° C.

Natural oils include animal oils and vegetable oils (e.g., lard oil, castor oil) as well as solvent-refined or acid-refined mineral oils of the paraffinic, naphthenic, or mixed paraffin-naphthenic types. Oils derived from coal or shale are also useful.

Synthetic oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.); alkyl benzenes (e.g., dodecylbenzenes, tetradecylbenzenes, dinonylbenzenes, di-(2-ethylhexyl) benzenes, etc.); polyphenyls (e.g., biphenyls, terphenyls, alkylated polyphenyls, etc.); and the like.

Another suitable class of synthetic oils that can be used comprises the esters of dicarboxylic acids (e.g., phthalic acid, succinic acid, alkyl succinic acid, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, pentaerytiritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, the 2-ethylhexyl diester of linoleic acid dimer, the complex ester formed by reacting one mole of sebacic acid with two moles of tetraethylene glycol and two moles of 2-ethyl-hexanoic acid, and the like.

Unrefined, refined and rerefined oils (and mixtures of each with each other) of the type disclosed hereinabove can be used. Unrefined oils are those obtained directly from a natural or synthetic source without further purification treatment. For example, a shale oil obtained directly from a retorting operation, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such as solvent extraction, distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed toward removal of spent additives and oil breakdown products.

Examples of useful oils include a white mineral oil available from Witco Chemical Company under the trade designation KAYDOL; a white mineral oil available from Shell under the trade designation ONDINA; and a mineral oil available from Pennzoil under the trade designation N-750-HT. Diesel fuel (e.g., Grade No. 2-D as specified in ASTM D-975) can be used as the oil.

The carbonaceous fuel can be any wax having melting point of at least about 25° C., such as petrolatum wax, microcrystalline wax, and paraffin wax, mineral waxes such as ozocerite and montan wax, animal waxes such as spermaceti wax, and insect waxes such as beeswax and Chinese wax. Useful waxes include waxes identified by the trade designations MOBILWAX 57 which is available from Mobil Oil Corporation; D02764 which is a blended wax available from Astor Chemical Ltd.; and VYBAR which is available from Petrolite Corporation. Preferred waxes are blends of microcrystalline waxes and paraffin.

Preferably, the organic fuel comprises a carbonaceous fuel comprising at least one member of the group consisting of diesel oil, mineral oil, vegetable oil and hydrocarbon wax.

In one embodiment, the carbonaceous fuel includes a combination of a wax and an oil. The wax content can be at least about 25% and preferably in the range of about 25% to about 90% by weight of the organic phase, and the oil content can be at least about 10% and preferably ranges from about 10% to about 75% by weight of the organic phase.

The Aqueous Oxidizer Phase

The aqueous oxidizer phase comprises at least one oxygen supplying component wherein said oxygen supplying component comprises at least 50% by weight of prilled agricultural grade ammonium nitrate. The aqueous phase of the emulsion is a discontinuous phase.

The Oxygen-Supplying Component

At least 50% by weight, often at least about 60% by weight, and more often to about 90% by weight, preferably to about 95% by weight and more preferably 100% by weight of the oxygen-supplying component is agricultural grade ammonium nitrate. Such material is supplied in the form of prills containing crystal habit modifiers to control crystal growth and one or more surfactants to reduce caking. Such materials are particularly useful for agricultural purposes but present serious emulsion stability difficulties when used in explosive emulsion compositions. Nonetheless, because of the unavailability of purer forms of ammonium nitrate in many parts of the world, it is often necessary that such material be not only the predominant oxygen supplying component, but often the sole oxygen supplying component. Thus in order to utilize such materials in explosive emulsions in significant amounts, it is necessary that an emulsifier be found to provide stable emulsions over extended periods of time.

In one embodiment ammonium nitrate prills made by the Kaltenbach-Thoring (KT) process are used. This process involves the use of one or more crystal growth modifiers to help control the growth of the crystals. It also involves the use of one or more surfactants which are used to reduce caking. An example of a commercially available material made by this process is Columbia KT ammonium nitrate prills which are marketed by Columbia Nitrogen. The crystal habit modifier and the surfactant used in the production of Columbia KT prills are each available from Lobeco Products, Inc., Beaufort S.C., USA, under the trade designation GALORYL. Other additives commonly found in agricultural grade ammonium nitrate prill are ammonium sulfate, magnesium stearate, talc, clay, including kaolin clay, magnesium nitrate, aluminum sulfate, limestone, amine surfactants sold by Berol Nobel AB, Stockholm Sweden under the tradename LILAMINE, and a variety of polymeric sulfonates.

Ammonium nitrate particulate solids, (e.g., ammonium nitrate prills), which are available in the form of preblended ammonium nitrate-fuel oil (ANFO) mixtures, can be used. Typically, ANFO contains about 94% by weight ammonium nitrate and about 6% fuel oil (e.g., diesel fuel oil), although these proportions can be varied. The emulsion explosives of this invention may contain up to about 90% by weight of prilled ammonium nitrate-fuel oil mixtures.

The agricultural grade, prilled ammonium nitrate may be incorporated into the aqueous phase at the outset, that is, it may be incorporated, in its entirety, into the aqueous component which is then emulsified to form the emulsion explosive.

More often a significant portion is incorporated into preformed emulsion, frequently at the job site.

The oxygen-supplying component may further comprise at least member selected from the group consisting of one inorganic oxidizer salt such as alkali and alkaline earth metal nitrate and ammonium, alkali and alkaline earth metal chlorate and perchlorate. Examples include sodium nitrate, calcium nitrate, ammonium chlorate, sodium perchlorate and ammonium perchlorate. Mixtures of ammonium nitrate and sodium or calcium nitrate are useful. In one embodiment, inorganic oxidizer salt comprises at least 50% by weight prilled agricultural grade ammonium nitrate and the balance of the oxidizer phase can comprise either an inorganic nitrate (e.g., alkali or alkaline earth metal nitrate) or an inorganic perchlorate (e.g., ammonium perchlorate or an alkali or alkaline earth metal perchlorate) or a mixture thereof.

The Emulsifier

As noted above, the emulsifier composition is at least one of an aliphatic hydrocarbon substituted succinic emulsifier having at least one of succinic ester groups, succinic amide groups, succinic imine groups, succinic ester-amide groups, and succinimide groups, at least one of which is substituted with an aminoalkyl group. More often, and preferably, both are substituted with an aminoalkyl group.

In one embodiment, the explosive emulsion compositions of this invention are prepared using an emulsifying amount of an emulsifier composition having the general formula

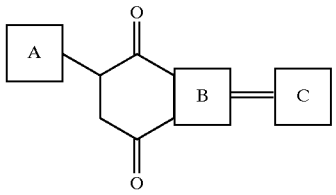

wherein

'A' comprises at least one aliphatic hydrocarbyl group containing from about 18, often from about 30, frequently from about 50 up to about 500 carbon atoms, often to about 200 carbon atoms, and frequently to about 150 and preferably up to about 100 carbon atoms, 'B' comprises groups $B^1$ and $B^2$ wherein each of $B^1$ and $B^2$ is independently selected from the group consisting of —N(R')— and —O—, and when taken together, $B^1$ and $B^2$ constitute an imide nitrogen atom, wherein each R' is independently selected from the group consisting of H, alkyl groups containing from 1 to about 18 carbon atoms, hydroxyhydrocarbyl groups, and aminohydrocarbyl groups; and 'C' comprises $C^1$ and $C^2$ wherein each of $C^1$ and $C^2$ is, independently, an aminoalkyl group and when B is an imide nitrogen atom, 'C' is an aminoalkyl group.

In one preferred embodiment, 'A' is a polyisobutenyl group.

In one embodiment, each of $B^1$ and $B^2$ is —O—. In another embodiment one member of $B^1$ and $B^2$ is —O— and the other member is —N($R^1$)—. In yet another embodiment, each of $B^1$ and $B^2$ is —N($R^1$)—. In a further embodiment, $B^1$ and $B^2$ together comprise an imide nitrogen atom and "C" is an aminoalkyl group.

The emulsifier is prepared by reacting a substituted succinic acylating agent with an appropriate amine as described in greater detail hereinafter.

Examples of patents describing various procedures for preparing useful acylating agents include U.S. Pat. Nos. 3,215,707; 3,219,666; 3,231,587; 3,912,764; 4,110,349; 4,234,435; and 5,041,662; and U.K. Patents 1,440,219 and 1,492,337. The disclosures of these patents are hereby incorporated by reference for their teachings with respect to the preparation of substituted succinic acylating agents.

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

Substituted succinic acids have the formula

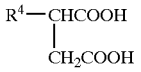

wherein $R^4$ is the same as 'A' as defined above. Also contemplated are the corresponding reactive equivalents, the anhydrides, ester acids, or lactone acids of this succinic acid. Succinic acids and reactive equivalents thereof, suitable for preparing the emulsions of this invention are aliphatic, preferably oil-soluble. In one embodiment, the carboxylic acylating agent is characterized by the presence within its structure of from about 0.8 to about 2 succinic groups, preferably from about 0.9 to about 1.1 succinic groups, and more preferably about 1 succinic group per aliphatic hydrocarbon based substituent. Preferably the substituent contains at least 18 carbon atoms, often from about 30 carbon atoms, more preferably at least about 50 carbon atoms, up to about 500, often to about 200, frequently about 150 and more preferably, up to about 100 carbon atoms.

$R^4$ is preferably an olefin, preferably alpha-olefin, polymer-derived group formed by polymerization of monomers such as ethylene, propylene, 1-butene, isobutene, 1-pentene, 2-pentene, 1-hexene and 3-hexene. Such groups usually contain from about 18, often from about 30, frequently from about 50, up to about 500, often up to about 200, more often up to about 100 carbon atoms. $R^4$ may also be derived from a high molecular weight substantially saturated petroleum fraction. The hydrocarbon-substituted succinic acids and their derivatives constitute the most preferred class of carboxylic acids.

Included among the useful carboxylic reactants are aliphatic hydrocarbon substituted cyclohexene dicarboxylic acids and anhydrides which may be obtained from the reaction of e.g., maleic anhydride with an olefin while the reaction mass is being treated with chlorine.

Patents describing useful aliphatic succinic acids, anhydrides, and reactive equivalents thereof and methods for preparing them include, among numerous others, U.S. Pat. No. 3,163,603 (LeSuer), U.S. Pat. No. 3,215,707 (Rense); U.S. Pat. No. 3,219,666 (Norman et al), U.S. Pat. No. 3,231,587 (Rense); U.S. Pat. No. 3,306,908 (LeSuer); U.S. Pat. No. 3,912,764 (Palmer); U.S. Pat. No. 4,110,349 (Cohen); and U.S. Pat. No. 4,234,435 (Meinhardt et al); and U.K. 1,440,219 which are hereby incorporated by reference for their disclosure of useful carboxylic reactants. It should be understood that these patents also disclose derivatives, such as succinimides, etc. which are not reactive equivalents of succinic acids and anhydrides. These are not contemplated as being reactive equivalents of succinic acids or anhydrides.

As indicated in the above-mentioned patents, which are hereby incorporated by reference for their disclosure of compounds useful as reactants for preparing the emulsifier of this invention, the succinic acids (or reactive equivalents thereof) include those derived by the reaction of a maleic or fumaric dicarboxylic acid or reactive equivalent thereof with a polyalkene or halogenated derivative thereof or a suitable olefin.

The aliphatic hydrocarbyl group, for example the "A" group of the emulsifier is referred to hereinafter, for convenience, as the "substituent" and is often derived from a polyalkene. The polyalkene is characterized by an $\overline{M}_n$ (number average molecular weight) value of at least about 250, preferably at least about 500, more preferably at least about 1000, up to about 7,000. Advantageously, the polyalkene has an $\overline{M}_n$ in the range of about 400 to about 7,000, more preferably about 800 to about 3000, more preferably about 800 to about 2000. The polyalkene typically has an $\overline{M}_w/\overline{M}_n$ value of at least about 1, often from about 1.5 up to about 5. $\overline{M}_w$ is the conventional symbol representing the weight average molecular weight. The aliphatic hydrocarbyl group may also be derived from higher molecular weight olefins, cracked wax, and other sources readily available in the art.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms, preferably from about 2 to about 6 carbon atoms, more preferably 2 to 4 carbon atoms. Interpolymers optionally containing up to about 40% of polymer units derived from internal olefins of up to about 16 carbon atoms are also within a preferred group. Another preferred class of polyalkenes are the latter more preferred polyalkenes optionally containing up to about 25% of polymer units derived from internal olefins of up to about 6 carbon atoms.

Interpolymers are those in which two or more olefin monomers are interpolymerized according to well-known conventional procedures to form polyalkenes having units within their structure derived from each of said two or more olefin monomers. Thus, "interpolymer(s)", or "copolymers" as used herein is inclusive of polymers derived from two different monomers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C═C<); that is, they are monoolefinic monomers such as ethylene, propylene, 1-butene, isobutene, and 1-octene or polyolefinic monomers (usually diolefinic monomers) such as 1,3-butadiene and isoprene. For purposes of this invention, when a particular polymerized olefin monomer can be classified as both a terminal olefin and an internal olefin, it will be deemed to be a terminal olefin. Thus, 1,3-pentadiene (i.e., piperylene) is deemed to be a terminal olefin for purposes of this invention.

In one preferred embodiment, the substituent is derived from polybutene, that is, polymers of $C_4$ olefins, including 1-butene, 2-butene and isobutylene. Those derived from isobutylene, i.e., polyisobutylenes, are especially preferred. In another preferred embodiment, the substituent is derived from polypropylene. In another preferred embodiment, it is derived from ethylene-alpha olefin polymers, particularly ethylene-propylene polymers and ethylene-alpha olefin-diene, preferably ethylene-propylene-diene polymers. In one embodiment the olefin is an ethylene-propylene-diene copolymer having $M_n$ ranging from about 900 to about 2500. An example of such materials are the TRILENE® polymers marketed by the Uniroyal Company, Middlebury, Conn., USA.

Polypropylene and polybutylene, particularly polyisobutylene, are preferred. These typically have number average molecular weight ranging from about 300 to about 7000, often to about 5,000, more often from about 700 to about 2,000.

One preferred source of substituent groups are polybutenes obtained by polymerization of a $C_4$ refinery stream having a butene content of 35 to 75 weight percent and isobutylene content of 15 to 60 weight percent in the presence of a Lewis acid catalyst such as aluminum trichloride or boron trifluoride. These polybutenes contain predominantly (greater than 80% of total repeating units) isobutylene repeating units of the configuration

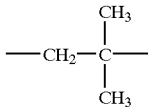

These polybutenes are typically monoolefinic, that is they contain but one olefinic bond per molecule.

The polybutene may comprise a mixture of isomers wherein from about 50 percent to about 65 percent are tri-substituted olefins wherein one substituent contains from 18 to about 500 aliphatic carbon atoms, often from about 30 to about 200 carbon atoms, more often from about 50 to about 100 carbon atoms, and the other two substituents are lower alkyl.

When the polybutene is a tri-substituted olefin, it frequently comprises a mixture of cis- and trans-1-lower alkyl, 1-(aliphatic hydrocarbyl containing from 30 to about 100 carbon atoms), 2-lower alkyl ethene and 1,1-di-lower alkyl, 2-(aliphatic hydrocarbyl containing from 30 to about 100 carbon atoms) ethene.

In one embodiment, the monoolefinic groups of the polybutenes are predominantly vinylidene groups, i.e., groups of the formula

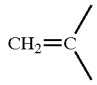

especially those of the formula

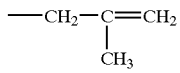

although the polybutenes may also comprise other olefinic configurations.

In one embodiment the polybutene is substantially monoolefinic, comprising at least about 30 mole %, preferably at least about 50 mole % vinylidene groups, more often at least about 70 mole % vinylidene groups. Such materials and methods for preparing them are described in U.S. Pat. Nos. 5,071,919; 5,137,978; 5,137,980; 5,286,823 and 5,408,018, and in published European patent application EP 646103-A1, each of which is expressly incorporated herein by reference. They are commercially available, for example under the tradenames ULTRAVIS® (BP Chemicals) and GLISSOPAL® (BASF).

Specific characterization of olefin reactants used in this invention can be accomplished by using techniques known to those skilled in the art. These techniques include general qualitative analysis by infrared and determinations of average molecular weight, e.g., $\overline{M}_n$ and $\overline{M}_w$, etc. employing vapor phase osmometry (VPO) and gel permeation chromatography (GPC). Structural details can be elucidated employing proton and carbon 13 ($^{13}C$) nuclear magnetic resonance (NMR) techniques. NMR is useful for determining substitution characteristics about olefinic bonds, and provides some details regarding the nature of the substituents. More specific details regarding substituents about the olefinic bonds can be obtained by cleaving the substituents from the olefin by, for example, ozonolysis, then analyzing the cleaved products, also by NMR, GPC, VPO, and by infra-red analysis and other techniques known to the skilled person.

Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}_n$ and $\overline{M}_w$ values of polymers are well known and are described in numerous books and articles. For example, methods for the determination of $\overline{M}_n$ and molecular weight distribution of polymers is described in W. W. Yau, J. J. Kirkland and D. D. Bly, "Modem Size Exclusion Liquid Chromatography", J. Wiley & Sons, Inc., 1979.

The preparation of polyalkenes as described above which meet the various criteria for $\overline{M}_n$ and $\overline{M}_w/\overline{M}_n$ is within the skill of the art and does not comprise part of the present invention. Techniques readily apparent to those skilled in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

Polyalkenes having the $\overline{M}_n$ and $\overline{M}_w$ values discussed above are known in the art and can be prepared according to conventional procedures. For example, some of these polyalkenes are described and exemplified in U.S. Pat. No. 4,234,435. The disclosure of this patent relative to such polyalkenes is hereby incorporated by reference. Several such polyalkenes, especially polybutenes, are commercially available.

The second group or moiety in the acylating agent is referred to herein as the "succinic group(s)". The succinic groups are those groups characterized by the structure

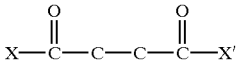

(I)

wherein X and X' are the same or different provided that at least one of X and X' is such that the substituted succinic acylating agent can function as a carboxylic acylating agent. That is, at least one of X and X' must be such that the substituted acylating agent can form, for example, amides and imides with amino compounds, and esters, amides and imides, etc., with the hydroxyamines, and otherwise function as a conventional carboxylic acid acylating agent. Transesterification and transamidation reactions are considered, for purposes of this invention, as conventional acylating reactions.

Thus, X and/or X' is usually —OH, —O-hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X') can enter into acylation reactions.

One of the unsatisfied valences in the grouping of Formula I forms a carbon-to-carbon bond with a carbon atom in 'A' the substituent group. While other such unsatisfied valence may be satisfied by a similar bond with the same or different substituent group, all but the said one such valence is usually satisfied by hydrogen; i.e., —H.

In one embodiment, the succinic groups correspond to the formula

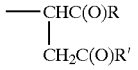

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably both R and R' are —OH or together are —O—, and mixtures thereof. Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

In preparing the substituted succinic acylating agents of this invention, one or more of the above-described polyalkenes is reacted with one or more acidic reactants selected from the group consisting of maleic or fumaric reactants of the general formula

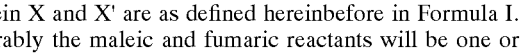

X(O)C—CH=CH—C(O)X' (III)

wherein X and X' are as defined hereinbefore in Formula I. Preferably the maleic and fumaric reactants will be one or more compounds corresponding to the formula

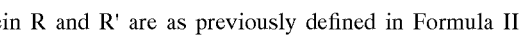

RC(O)—CH=CH—C(O)R' (IV)

wherein R and R' are as previously defined in Formula II herein. Ordinarily, the maleic or fumaric reactants will be maleic acid, fumaric acid, maleic anhydride, or a mixture of two or more of these. Due to availability and ease of reaction, maleic reactants and especially maleic anhydride will usually be employed.

For convenience and brevity, the term "maleic reactant" is sometimes used to refer to the acidic reactants used to prepare the succinic acylating agents. When used, it should be understood that the term is generic to acidic reactants selected from maleic and fumaric reactants including mixtures of such reactants.

Amine Reactants

The succinic ester, succinic amide, succinic imine and succinimide and the aminoalkyl substituent thereon, e.g., the groups 'B' and 'C' are derived from the reaction of an amine with the succinic reactant. The amines must be polyfunctional; i.e., contain one group which can react with the succinic acylating agent and a residual aminoalkyl group which results in the group 'C'.

The amines useful in making the emulsifiers include primary amines, secondary amines and tertiary amines, with the secondary and tertiary amines being preferred and the tertiary amines being particularly useful. These amines can be monoamines or polyamines. Hydroxy amines, especially tertiary alkanol monoamines, are useful. Mixtures of two or more amines can be used.

The amines must contain an aminoalkyl group. Additional amino groups in polyamines can be aliphatic, cycloaliphatic, aromatic or heterocyclic, including aliphatic-substituted aromatic, aliphatic-substituted cycloaliphatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted cycloaliphatic and heterocyclic-substituted aromatic amines. These amines may be saturated or unsaturated, preferably free from acetylenic unsaturation. The amines may also contain non-hydrocarbon substituents or groups as long as these groups do not significantly interfere with the reaction of the amines with the acylating agents. Such non-hydrocarbon substituents or groups include lower alkoxy, lower alkyl, mercapto, nitro, and interrupting groups such as —O— and —S— (e.g., as in such groups as —$CH_2CH_2$—X—$CH_2CH_2$— where X is —O— or —S—).

With the exception of the branched polyalkylene polyamines, the polyoxyalkylene polyamines and the high molecular weight hydrocarbyl-substituted amines described more fully hereinafter, the amines used in this invention ordinarily contain less than about 40 carbon atoms in total and usually not more than about 20 carbon atoms in total.

Suitable polyamines include aliphatic, cycloaliphatic and aromatic polyamines analogous to monoamines except for the presence within their structure of another amino nitrogen. The other amino nitrogen can be a primary, secondary or tertiary, preferably tertiary, amino nitrogen.

Heterocyclic mono- and polyamines can also be used. As used herein, the terminology "heterocyclic mono- and polyamine(s)" is intended to describe those heterocyclic amines containing at least one primary, secondary or tertiary amino group and at least one nitrogen as a heteroatom in the heterocyclic ring. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain heteroatoms other than nitrogen, especially oxygen and sulfur. Obviously they can contain more than one nitrogen heteroatom. The 5- and 6-membered heterocyclic rings are preferred.

Among the suitable heterocyclics are the polyfunctional heterocyclic amines such as piperazine and hydroxyalkyl and aminoalkyl N-containing heterocycles. These include the aziridines, azetidines, azolidines, tetra- and di-hydro pyridines, pyrroles, indoles, piperazines, imidazoles, di- and tetra-hydroimidazoles piperazines, isoindoles, purines, morpholines, thiomorpholines, N-aminoalkyl-morpholines, N-amino-alkylthiomorpholines, N-aminoalkyl-piperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring. Aminoalkyl-substituted piperidines, piperazine, aminoalkyl-substituted piperazines, aminoalkyl-substituted morpholines, and aminoalkyl-substituted pyrrolidines, are useful. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethyl-piperazine.

The tertiary amines include monoamines and polyamines. The monoamines can be represented by the formula

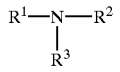

wherein two members of $R^1$, $R^2$ and $R^3$ are the same or different hydrocarbyl groups and one member is a hydroxy alkyl group. When one of the members is an aminoalkyl group, the tertiary amine is a polyamine. Preferably, the two members $R^1$, $R^2$ and $R^3$ are independently hydrocarbyl groups of from 1 to about 20 carbon atoms.

Hydroxyamines, both mono- and polyamines, analogous to those mono- and polyamines described herein are also useful. The hydroxy-substituted amines contemplated are those having hydroxy substituents bonded directly to a carbon atom other than a carbonyl carbon atom; that is, they have hydroxy groups capable of functioning as alcohols. The hydroxyamines can be primary, secondary or tertiary amines, with the secondary and tertiary amines being preferred, and the tertiary amines being especially preferred. The terms "hydroxyamine" and "aminoalcohol" describe the same class of compounds and, therefore, can be used interchangeably.

The hydroxyamines include N-(hydroxyl-substituted hydrocarbyl) amines, hydroxyl-substituted poly (hydrocarbyloxy) analogs thereof and mixtures thereof. Alkanol amines can be represented, for example, by the formulae:

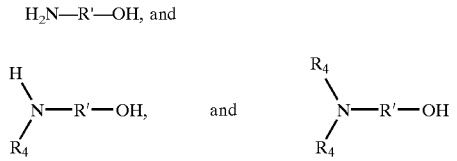

wherein each $R_4$ is independently a hydrocarbyl group of one to about 22 carbon atoms or hydroxyhydrocarbyl group of two to about 22 carbon atoms, preferably one to about eight and often to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R_4$ is independently a methyl, ethyl, propyl, butyl, pentyl or hexyl group.

Examples of the N-(hydroxyl-substituted hydrocarbyl) amines include mono-, di- and triethanolamine, dimethylethanolamine, diethylethanolamine, di-(3-hydroxypropyl) amine, N-(3-hydroxybutyl) amine, N-(4-hydroxybutyl) amine, N,N-di-(2-hydroxypropyl) amine, N-(2-hydroxyethyl) morpholine and its thio analog, N-(2-hydroxyethyl) cyclohexylamine, N-3-hydroxyl cyclopentylamine, o-, m- and p-aminophenol, N-(hydroxyethyl) piperazine, N,N'-di(hydroxyethyl) piperazine, and the like.

Preferred are secondary and tertiary alkanol amines. Especially preferred are tertiary alkanol amines.

The hydroxyamines can also be ether N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

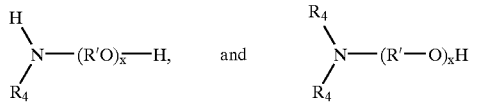

wherein x is a number from about 2 to about 15 and $R_4$ and R' are as described above. $R_4$ may also be a hydroxypoly (hydrocarbyloxy) group.

In a particularly advantageous embodiment, the hydroxyamine is a compound represented by the formula

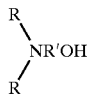

wherein each R is independently an alkyl group of 1 to about 4 carbon atoms, preferably 1 or 2 carbon atoms, and R' is an alkylene group of 2 to about 4 carbon atoms, preferably about 2 or 3 carbon atoms.

Polyamine analogs of these hydroxy amines, including alkoxylated alkylene polyamines (e.g., NN-(diethanol)-ethylene diamine), can be used. Such polyamines can be made by reacting alkylene amines (e.g., ethylenediamine) with one or more alkylene oxides (e.g., ethylene oxide, octadecene oxide) of two to about 20 carbons. Similar alkylene oxide-alkanol amine reaction products can also be used such as the products made by reacting the afore-described secondary or tertiary alkanol amines with ethylene, propylene or higher epoxides in a 1:1 or 1:2 molar ratio. Reactant ratios and temperatures for carrying out such reactions are known to those skilled in the art.

Specific examples of alkoxylated alkylene polyamines include N-(2-hydroxyethyl) ethylene diamine, N,N-bis(2-hydroxyethyl)-ethylene-diamine, 1-(2-hydroxyethyl) piperazine, mono(hydroxypropyl)-substituted diethylene triamine, di(hydroxypropyl)-substituted tetraethylene pentamine, N-(3-hydroxybutyl)-tetramethylene diamine, etc. Higher homologs obtained by condensation of the above-illustrated hydroxy alkylene polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid mono- or polyamines are also useful.

Hydroxyalkyl alkylene polyamines having one or more hydroxyalkyl substituents on the nitrogen atoms, are also useful. Useful hydroxyalkyl-substituted alkylene polyamines include those in which the hydroxyalkyl group is a lower hydroxyalkyl group. Examples of such hydroxyalkyl-substituted polyamines include N-(2-hydroxyethyl) ethylene diamine, N,N-bis(2-hydroxyethyl) ethylene diamine, 1-(2-hydroxyethyl)-piperazine, monohydroxypropyl-substituted diethylene triamine, dihydroxypropyl-substituted tetraethylene pentamine, N-(3-hydroxybutyl) tetramethylene diamine, etc. Higher homologs as are obtained by condensation of the above-illustrated hydroxy alkylene polyamines through amino groups or through hydroxy groups are likewise useful. Condensation through amino groups results in a higher amine accompanied by removal of ammonia and condensation through the hydroxy groups results in products containing ether linkages accompanied by removal of water.

Useful polyamines include the alkylene polyamines represented by the formula:

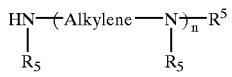

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently hydrogen or a hydrocarbyl group, preferably an aliphatic group, or a hydroxy-substituted hydrocarbyl group, preferably a hydroxy-substituted aliphatic group of up to about 30 carbon atoms. Preferably $R_5$ is H or lower alkyl, most preferably, H. Useful alkylene polyamines include those wherein each R is hydrogen with the ethylene polyamines, and mixtures of ethylene polyamines being particularly preferred.

Alkylene polyamines that are useful include methylene polyamines, ethylene polyamines, butylene polyamines, propylene polyamines, pentylene polyamines, hexylene polyamines, heptylene polyamines, etc. Also included are ethylene diamine, triethylene tetramine, propylene diamine, trimethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene) triamine, N-(2-aminoethyl) piperazine, 1,4-bis(2-aminoethyl) piperazine, and the like. Higher homologs as are obtained by condensing two or more of the above-illustrated alkylene amines are useful as amines in this invention as are mixtures of two or more of any of the afore-described polyamines.

Ethylene polyamines, such as some of those mentioned above, are preferred. They are described in detail under the heading "Diamines and Higher Amines" in Kirk Othmer's "Encyclopedia of Chemical Technology", 4th Edition, Vol. 8, pages 74–108, John Wiley and Sons, New York (1993) and in Meinhardt, et al, U.S. Pat. No. 4,234,435, both of which are hereby incorporated herein by reference for disclosure of useful polyamines. Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas, designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylenepentamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four.

Examples of polyhydric amines include tri-(hydroxypropyl) amine, tris-(hydroxymethyl)amino methane, 2-amino-2-methyl-1,3-propanediol, N,N',N,N'-tetrakis(2-hydroxypropyl) ethylenediamine, and N,N,N',N'-tetrakis(2-hydroxyethyl) ethylenediamine.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst. Amine condensates and methods of making the same are described in Steckel (U.S. Pat. No. 5,053,152) which is incorporated by reference for its disclosure to the condensates and methods of making amine condensates.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the afore-described primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, NN-di-(2-hydroxyethyl)-ethylenediamine, 1-(2-hydroxyethyl) piperazine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be an aminoalkyl substituted or hydroxyalkyl substituted heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylthiomorpholines, N-aminoalkylmorpholines, N-aminoalkylpiperazines, N,N'-bisaminoalkyl piperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, morpholine, aminoakylsubstituted morpholines, pyrrolidine, and aminoalkylsubstituted pyrrolidines, are especially preferred. Usually the aminoalkyl substituents are substituted on a nitrogen atom forming part of the hetero ring. Specific examples of such heterocyclic amines include N-aminopropylmorpholine, N-amino-ethylpiperazine, and N,N'-diaminoethyl-piperazine. Hydroxy alkyl substituted heterocyclic polyamines are also useful. Examples include N-hydroxyethylpiperazine and the like.

In another embodiment, the amine is a polyalkene-substituted amine. These polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include N,N-di(hydroxyethyl)-N-polybutene amine; N-(2-hydroxypropyl)-N-polybutene amine; N-poly(butene) ethylenediamine; N-poly(propylene)trimethylenediamine; N-poly(butene)diethylenetriamine; N',N'-poly(butene) tetraethylene-pentamine; and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by $\overline{M}_n$ of at least about 500. Generally, the polyalkene substituted amine is characterized by $\overline{M}_n$ of about 500 to about 5000, preferably about 800 to about 2500. In another embodiment $\overline{M}_n$ ranges from about 500 to about 1200 or 1300.

The polyalkenes from which the polyalkene substituted amines are derived are the same as those from which the substituents of the succinic emulsifier are derived.

Hydrazine and substituted-hydrazine can also be used as amines in this invention. At least one of the nitrogens in the hydrazine must contain a hydrogen directly bonded thereto and one must have an aminoalkyl or a hydroxyalkyl substituent. Other substituents which may be present on the hydrazine include alkyl, alkenyl, aryl, aralkyl, alkaryl, and the like. Usually, the other substituents are alkyl, especially lower alkyl, phenyl, and substituted phenyl such as lower alkoxy-substituted phenyl or lower alkyl-substituted phenyl.

Another group of amines suitable for use in this invention are branched polyalkylene polyamines. The branched polyalkylene polyamines are polyalkylene polyamines wherein the branched group is a side chain containing on the average at least one nitrogen-bonded aminoalkylene i.e., a

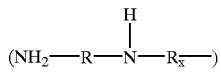

group per nine amino units present on the main chain; for example, 1–4 of such branched chains per nine units on the main chain, but preferably one side chain unit per nine main chain units. Thus, these polyamines contain at least three primary amino groups and at least one tertiary amino group.

Suitable amines also include polyoxyalkylene polyamines, e.g., polyoxyalkylene diamines and polyoxyalkylene triamines, having average molecular weights ranging from about 200 to about 4000, preferably from about 400 to 2000. Examples of these polyoxyalkylene polyamines include those amines represented by the formula:

$$NH_2\text{-Alkylene-}(\text{—O-Alkylene-})_m NH_2$$

wherein m has a value of from about 3 to about 70, preferably from about 10 to about 35; and the formula:

$$R\text{-}[\text{Alkylene-}(\text{—O-Alkylene-})_m NH_2]_{3\text{-}6}$$

wherein n is a number in the range of from 1 to about 40, with the proviso that the sum of all of the n's is from about 3 to about 70 and generally from about 6 to about 35, and R is a polyvalent saturated hydrocarbyl group of up to about 10 carbon atoms having a valence of from about 3 to about 6. The alkylene groups may be straight or branched chains and contain from 1 to about 7 carbon atoms, and usually from 1 to about 4 carbon atoms. The various alkylene groups present within the above formulae may be the same or different.

Useful polyoxyalkylene polyamines include the polyoxyethylene and polyoxypropylene diamines and the polyoxypropylene triamines having average molecular weights ranging from about 200 to about 2000. The polyoxyalkylene polyamines are commercially available from the Jefferson Chemical Company, Inc. under the trade name "Jeffamine". U.S. Pat. Nos. 3,804,763 and 3,948,800 are incorporated herein by reference for their disclosure of such polyoxyalkylene polyamines.

The carboxylic derivative compositions produced from the acylating agents and the amines described hereinbefore comprise acylated amines which typically include one or more amides, imides as well as mixtures of two or more thereof. When the amine is a hydroxyamine, the carboxylic derivative compositions usually include esters.

To prepare the carboxylic acid derivative compositions from the acylating agents and the amines, one or more acylating agents and one or more amines are heated, optionally in the presence of a normally liquid, substantially inert organic liquid solvent/diluent, at temperatures in the range of about 50° C. up to the decomposition point of the reactant or product having the lowest such temperature, but normally at temperatures in the range of about 120° C. up to about 300° C. provided 300° C. does not exceed the decomposition point. Temperatures of about 150° C. to about 200° C. can be used.

Because the acylating agents can be reacted with the amine reactants in the same manner as the high molecular weight acylating agents of the prior art are so reacted, U.S. Pat. Nos. 3,172,892; 3,219,666; 3,272,746; and 4,234,435 are expressly incorporated herein by reference for their disclosures with respect to the procedures applicable to reacting the acylating agents with ammonia and amines.

In one embodiment, the acylating agent is reacted with from about 0.5 to about 3, preferably about 0.5 to about 2, more preferably about 0.5 to about 1.5, more preferably about 0.8 to about 1.2, preferably 1, equivalents of amine per equivalent of acylating agent. The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the % N contained in the polyamine and multiplying by 100; thus, a polyamine mixture containing 34% N would have an equivalent weight of 41.2. An equivalent weight of ammonia or a monoamine is its molecular weight.

An equivalent weight of a hydroxyamine to be reacted with the acylating agent under amide- or imide-forming conditions is its molecular weight divided by the total number of nitrogens present in the molecule. Under such conditions, the hydroxyl groups are ignored when calculating equivalent weight. Thus, ethanolamine would have an equivalent weight equal to its molecular weight, and diethanolamine would have an equivalent weight (based on nitrogen) equal to its molecular weight when such amines are reacted under amide- or imide-forming conditions.

The equivalent weight of a hydroxyamine to be reacted with the acylating agent under ester-forming conditions is its molecular weight divided by the number of hydroxyl groups present, and the nitrogen atoms present are ignored. Thus, when preparing esters from diethanolamine, the equivalent weight of the diethanolamine is one-half of its molecular weight.

One —$NH_2$ group can react with two —COOH groups to form an imide. If only secondary nitrogens are present in the amine compound, each >NH group can react with only one —COOH group. Accordingly, the amount of polyamine to be reacted with the acylating agent to form the amide or imide derivatives of the invention can be readily determined from a consideration of the number and types of nitrogen atoms in the polyamine (i.e., —$NH_2$, >NH, and >N—).

The preparation of acylating agents is illustrated in the following Examples 1–14, and the preparation of compositions useful as emulsifiers in the inventive emulsions is illustrated in Examples A–N. In the examples, and elsewhere in the specification and claims, all temperatures are in degrees Celsius, and all percentages and parts are by weight, unless otherwise clearly indicated. All analytical values are by analysis.

EXAMPLE 1

A mixture of 1000 parts of polyisobutene ($\overline{M}_n$=1750; $\overline{M}_w$=6300) and 106 parts of maleic anhydride is heated to 138° C. This mixture is heated to 190° C. in 9–14 hours during which time 90 parts of liquid chlorine are added. The reaction mixture is adjusted with chlorine addition, maleic anhydride addition or nitrogen blowing as needed to provide a polyisobutene-substituted succinic acylating agent composition with a total acid number of 95, a free maleic anhydride content of no more than 0.6% by weight, and a chlorine content of about 0.8% by weight. The composition has flash point of 180° C., a viscosity at 150° C. of 530 cSt, and a viscosity at 100° C. of 5400 cSt. The ratio of succinic groups to equivalent weights of polyisobutene in the acylating agent is 1.91.

EXAMPLE 2

A mixture of 510 parts of polyisobutene ($\overline{M}_n$=1845; $\overline{M}_w$=5325) and 59 parts of maleic anhydride is heated to 110° C. This mixture is heated to 190° C. in 7 hours during which 43 parts of gaseous chlorine is added beneath the surface. At 190–192° C. an additional 11 parts of chlorine is added over 3.5 hours. The reaction mixture is stripped by heating at 190–193° C. with nitrogen blowing for 10 hours. The residue is the desired polyisobutene-substituted succinic acylating agent having a saponification equivalent number of 87 as determined by ASTM procedure D-94.

EXAMPLE 3

A mixture of 1000 parts of polyisobutene ($\overline{M}_n$=2020; $\overline{M}_w$=6049) and 115 parts (1.17 moles) of maleic anhydride is heated to 110° C. This mixture is heated to 184° C. in 6 hours during which 85 parts of gaseous chlorine is added beneath the surface. At 184–189° C. an additional 59 parts of chlorine is added over 4 hours. The reaction mixture is stripped by heating at 186–190° C. with nitrogen blowing for 26 hours. The residue is the desired polyisobutene-substituted succinic acylating agent having a saponification equivalent number of 87 as determined by ASTM procedure D-94.

EXAMPLE 4

A mixture of 3000 parts of polyisobutene ($\overline{M}_n$=1845; $\overline{M}_w$=5325) and 344 parts of maleic anhydride is heated to 140° C. This mixture is heated to 201° C. in 5.5 hours during which 312 parts of gaseous chlorine is added beneath the surface. The reaction mixture is heated at 201–236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

EXAMPLE 5

A mixture of 3000 parts of polyisobutene ($\overline{M}_n$=2020; $\overline{M}_w$=6049) and 364 parts of maleic anhydride is heated at 220° C. for 8 hours. The reaction mixture is cooled to 170° C. At 170–190° C., 105 parts of gaseous chlorine are added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

EXAMPLE 6

A mixture of 800 parts of a polyisobutene having an $\overline{M}_n$ of about 2000, 646 parts of mineral oil and 87 parts of maleic anhydride is heated to 179° C. in 2.3 hours. At 176–180° C., 100 parts of gaseous chlorine is added beneath the surface over a 19 hour period. The reaction mixture is stripped by blowing with nitrogen for 0.5 hour at 180° C. The residue is an oil-containing solution of the desired polyisobutene-substituted succinic acylating agent.

EXAMPLE 7

The procedure for Example 2 is repeated except the polyisobutene ($\overline{M}_n$=1845; $\overline{M}_w$=5325) is replaced on an equimolar basis by polyisobutene ($\overline{M}_n$=1457; $\overline{M}_w$=5808).

EXAMPLE 8

The procedure for Example 2 is repeated except the polyisobutene ($\overline{M}_n$=1845; $\overline{M}_w$=5325) is replaced on an equimolar basis by polyisobutene ($\overline{M}_n$=2510; $\overline{M}_w$=5793).

EXAMPLE 9

The procedure for Example 2 is repeated except the polyisobutene ($\overline{M}_n$=1845; $\overline{M}_w$=5325) is replaced on an equimolar basis by polyisobutene ($\overline{M}_n$=3220; $\overline{M}_w$=5660).

EXAMPLE 10

A mixture of 6400 parts (4 moles) of a polybutene comprising predominantly isobutene units and having a number average molecular weight of about 1600 and 408 parts (4.16 moles) of maleic anhydride is heated at 225–240° C. for 4 hours. It is then cooled to 170° C. and an additional 102 parts (1.04 moles) of maleic anhydride is added, followed by 70 parts (0.99 mole) of chlorine; the latter is added over 3 hours at 170–215° C. The mixture is heated for an additional 3 hours at 215° C. then vacuum stripped at 220° C. and filtered through diatomaceous earth. The product is the desired polybutenyl-substituted succinic anhydride having a saponification number of 61.8.

EXAMPLE 11

A polybutenyl succinic anhydride is prepared by the reaction of a chlorinated (4.3% Cl) polybutylene with maleic anhydride at 200° C. The polybutenyl radical contains an average of about 70 carbon atoms and contains primarily isobutene units. The resulting alkenyl succinic anhydride is found to have an acid number of 103.

EXAMPLE 12

A lactone acid is prepared by reacting 2 equivalents of a polyolefin ($\overline{M}_n$ about 900) substituted succinic anhydride with 1.02 equivalents of water at a temperature of about 90° C. in the presence of a catalytic amount of concentrated sulfuric acid. Following completion of the reaction, the sulfuric acid catalyst is neutralized with sodium carbonate and the reaction mixture is filtered.

EXAMPLE 13

A reactor is charged with 1000 parts of polybutene having a number average molecular weight determined by vapor phase osmometry of about 950 and which consists primarily of isobutene units, followed by the addition of 108 parts of maleic anhydride. The mixture is heated to 110° C. followed by the sub-surface addition of 100 parts $Cl_2$ over 6.5 hours at a temperature ranging from 110 to 188° C. The exothermic reaction is controlled as not to exceed 188° C. The batch is blown with nitrogen then stored.

EXAMPLE 14

A reactor is charged with 1000 parts of a polybutene having a number average molecular weight of about 1500 and 47.9 parts molten maleic anhydride. The materials are heated to 138° C. followed by chlorination, allowing the temperature to rise to between 188–191° C., heating and chlorinating until the acid number is between 43 and 49 (about 40–45 parts $Cl_2$ are utilized). The materials are heated at 224–227° C. for about 2.5 hours until the acid number stabilizes. The reaction product is diluted with 438 parts mineral oil diluent and filtered with a diatomaceous earth filter aid.

EXAMPLE A

A mixture of 4920 parts (8.32 equivalents) of the polyisobutene-substituted succinic acylating agent prepared in accordance with the teachings of Example 1 and 2752 parts of a 40 Neutral oil are heated to 50–55° C. with stirring. 742 parts (8.32 equivalents) of dimethylethanolamine are added over a period of 6 minutes. The reaction mixture exotherms to 59° C. The reaction mixture is heated to 115° C. over a period of 3 hours. Nitrogen blowing is commenced at a rate of 1.5 standard cubic feet per hour, and the reaction mixture is heated to 135° C. over a period of 0.5 hour. The mixture is heated to and maintained at a temperature of 140–160° C. for 14 hours, then cooled to room temperature to provide the desired product. The product has a nitrogen content of 1.35% by weight, a total acid number of 13.4, a total base number of 54.8, a viscosity at 100° C. of 125 cSt, a viscosity at 40° C. of 2945 cSt, a specific gravity at 15.6° C. of 0.94, and a flash point of 82° C.

EXAMPLE B

A mixture of 1773 parts (3 equivalents) of the polyisobutene-substituted succinic acylating agent prepared in accordance with the teachings of Example 1 and 992 parts of a 40 Neutral oil are heated to 80° C. with stirring. 267 parts (3 equivalents) of dimethylethanolamine are added over a period of 6 minutes. The reaction mixture is heated to 132° C. over a period of 2.75 hours. The mixture is heated to and maintained at a temperature of 150–174° C. for 12 hours, then cooled to room temperature to provide the desired product. The product has a nitrogen content of 0.73% by weight, a total acid number of 12.3, a total base number of 29.4, a viscosity at 100° C. of 135 cSt, a viscosity at 40° C. of 2835 cSt, a specific gravity at 15.6° C. of 0.933, and a flash point of 97° C.

EXAMPLE C

The procedure of Example B is repeated except that after the product is cooled to room temperature, 106 parts of dimethylethanolamine are added with stirring. The resulting product has a nitrogen content of 1.21% by weight, a total acid number of 11.3, a total base number of 48.9, a viscosity at 100° C. of 110 cSt, a viscosity at 40° C. of 2730 cSt, a specific gravity at 15.6° C. of 0.933, and a flash point of 90° C.

EXAMPLE D

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 2 at 138° C. The reaction mixture is heated to 150° C. in 2 hours and stripped by blowing with nitrogen. The reaction mixture is filtered to yield the filtrate as an oil solution of the desired product.

EXAMPLE E

A reaction flask is charged with 698 parts of mineral oil and 108 parts of a commercial polyethylene polyamine mixture having typical % N=34. The materials are stirred and heated to 135° C. at which time 1000 parts of a polybutene substituted succinic anhydride prepared according to the procedure of Example 10 are added over 1 hour. With $N_2$ sparging, the temperature is increased to 160° C. and held there for 4 hours while removing water and other volatile components. The product is filtered using a diatomaceous earth filter aid yielding a filtrate typically containing 2% N and a total base number of 45.

EXAMPLE F

A polybutene having a number average molecular weight=1350 (1000 parts) is reacted with 106 parts maleic anhydride with $Cl_2$ blowing (total $Cl_2$ about 90 parts). To a reactor containing 1000 parts of the substituted succinic anhydride is added 1050 parts mineral oil, the materials are heated, with mixing, to 120° C., followed by addition of 70 parts of the commercial amine mixture described in Example E. The reaction mixture is heated to 155° C. over 4 hours with $N_2$ sparging to remove volatiles then filtered employing a diatomaceous earth filter aid. The filtrate typically contains, by analysis, 1.1% N and has a total base number=20.

EXAMPLE G

An acylated polyamine is prepared by reacting 1000 parts of polyisobutenyl ($\overline{M}_n$ 1000) substituted succinic anhydride with 85 parts of a commercial ethylene polyamine mixture having an average nitrogen content of about 34.5% in 820 parts mineral oil diluent under conditions described in LeSuer, U.S. Pat. No. 3,172,892.

EXAMPLE H

A composition is prepared by reacting a mixture of 275 parts mineral oil, 147 parts of a commercial ethyleneamine mixture having an average composition corresponding to that of tetraethylenepentamine and 1000 parts of polyisobutene ($\overline{M}_n \approx 1000$) substituted succinic anhydride at 120–125° C. for 2 hours and at 150° C. for 2 hours then blown with nitrogen at 150° C. for 5 hours to form an acylated amine.

EXAMPLE I

A solution of 698 parts mineral oil and 108 parts commercial ethylene polyamine mixture containing an average of about 34% nitrogen is prepared and heated to 115° C. To the oil solution is added 1000 parts of the polybutenyl-substituted succinic anhydride of Example 12 under $N_2$ followed by heating to 150° C. The reaction is continued at 143–150° C. for 1 hour. The product is then filtered.

EXAMPLE J

The procedure of Example F is repeated except the polybutenyl group on the substituted succinic anhydride is derived from a polyisobutene having a number average molecular weight, measured by vapor phase osmometry, of about 1700.

EXAMPLE K

To a mixture of 300 parts of the anhydride of Example E in 160 parts mineral oil are added, at 65–95° C., 25 parts of the ethylene polyamine mixture of Example G followed by heating to 150° C. with $N_2$ blowing to dry the material, then diluted with 79 parts mineral oil.

EXAMPLE L

Reacted are 2178 parts of the polybutenyl succinic anhydride of example 11 and 292 parts of triethylene tetramine in 1555 parts mineral oil at 215° C. for 12 hours, removing aqueous distillate.

EXAMPLE M

A reactor is charged with 300 parts of a polyisobutenyl substituted succinic anhydride prepared as in Example 13 and 232.1 parts mineral oil (Valvoline/Ashland 100N). The materials are heated to 90° C. under $N_2$ followed by addition of 47.1 parts dimethylethanolamine over 2 minutes. The temperature increases exothermically to 97° C. While maintaining $N_2$, the materials are stirred and heated at 150° C. for 4 hours then at 160° C. for a total of 9 hours. The materials are the product. Total Acid no (TAN)=13.5; Total Base No (TBN)=48.5.

EXAMPLE N

A reactor is charged with 289.6 parts of a polyisobutenyl substituted succinic anhydride prepared as in Example 13 and 214.6 parts mineral oil (Valvoline/Ashland 100N). The materials are heated to 41° C. under $N_2$ followed by addition of 31.6 parts dimethylaminopropylamine over 50 minutes. The temperature is maintained below 50° C. While maintaining $N_2$, the materials are stirred for 20 minutes. The materials are the product. TAN=26.9; TBN=40.2.

EXAMPLE O

A reactor is charged with 294.3 parts of the product of Example 1 and 229 parts mineral oil (Valvoline/Ashland 100N). The materials are mixed and 59.4 parts diethyl ethanolamine are added and the materials are heated, under $N_2$, to 160° C. over 6 hours while removing aqueous distillate. The materials are the product. TAN=13.5; TBN=42.3, % N=0.93.

EXAMPLE P

A reactor is charged with 147.4 parts of the product of Example 13 and 122 parts mineral oil (Valvoline/Ashland 100N). The materials are mixed and 35.6 parts diethyl ethanolamine are added and the materials are heated, under $N_2$, to 165° C. over 4 hours while removing aqueous distillate. The materials are the product. TAN=8.4; TBN=50.6, % N=1.27.

EXAMPLE Q

A reactor is charged with 605 parts of the product of Example 13 and 445 parts mineral oil (Valvoline/Ashland 100N). The materials are mixed while heating to 45° C., parts diethyl ethanolamine are added over 1 hour, maintaining 45° C., then 45° C. is maintained for 0.25 hour. The materials are heated, under $N_2$, to 120° C. and the temperature is maintained at 120° C. for 4 hours while removing aqueous distillate. The materials are the product. TAN=3.7; TBN=33.6, % N=1.50.

EXAMPLE R

A reactor is charged with 605 parts of the product of Example 13 and 445 parts 100N mineral oil. Under $N_2$, the mixture is warmed to 45° C. and 61.1 parts dimethylaminopropylamine are added, dropwise over 1 hour while maintaining 44–48° C. After addition is completed, the materials are held at 45° C. for 0.25 hour. A Dean-Stark trap is added to the reactor and the materials are heated to 120° C. and held at temperature for 4 hours while collecting distillate. The residue is the product. TAN=3.7; TBN=33.6; % N=1.50.

Sensitizers

Sensitizers are materials optionally incorporated into the explosive emulsion to help insure that the emulsion works as an explosive; i.e., they improve the tendency of the explosive emulsion to detonate. Sensitizers of all types are used in sensitizing amounts, usually in amounts less than about 15% by weight of the emulsion composition.

In one embodiment of the invention, closed-cell, void-containing materials are used as sensitizing components. The term "closed-cell, void-containing material" is used herein to mean any particulate material which comprises closed cell, hollow cavities. Each particle of the material can contain one or more closed cells, and the cells can contain a gas, such as air, or can be evacuated or partially evacuated. In one embodiment of the invention, sufficient closed cell, void containing material is used to yield a density in the resulting emulsion of from about 0.8 to about 1.35 g/cc, more preferably about 0.9 to about 1.3 g/cc, more preferably about 1.1 to about 1.3 g/cc. In general, the emulsions of the subject invention can contain up to about 15% by weight, preferably from about 0.25% to about 15% by weight of the closed cell void containing material. Preferred closed cell void containing materials are discrete glass spheres having a particle size within the range of about 10 to about 175 microns. In general, the bulk density of such particles can be within the range of about 0.1 to about 0.4 g/cc. Useful glass microbubbles or microballoons which can be used are the microbubbles sold by 3M Company and which have a particle size distribution in the range of from about 10 to about 160 microns and a nominal size in the range of about 60 to 70 microns, and densities in the range of from about 0.1 to about 0.4 g/cc. Microballoons identified by the industry designation C15/250 which have a particle density of 0.15 $\mu$m/cc and 10% of such microballoons crush at a static pressure of 250 psig can be used. Also, microballoons identified by the designation B37/2000 which have a particle density of 0.37 gm/cc and 10% of such microballoons crush at a static pressure of 2000 psig can be used. Other useful glass microballoons are sold under the trade designation of ECCOSPHERES by Emerson & Cumming, Inc., and generally have a particle size range from about 44 to about 175 microns and a bulk density of about 0.15 to about 0.4 g/cc. Other suitable microballoons include the inorganic microspheres sold under the trade designation of Q-CEL by Philadelphia Quartz Company.

The closed cell, void containing material can be made of inert or reducing materials. For example, phenol-formaldehyde microbubbles can be utilized within the scope of this invention. If the phenol-formaldehyde microbubbles are utilized, the microbubbles themselves are a fuel component for the explosive and their fuel value should be taken into consideration when designing a water-in-oil emulsion explosive composition. Another closed cell, void containing material which can be used within the scope of the subject invention are the SARAN® microspheres sold by Dow Chemical Company. The Saran microspheres have a diameter of about 30 microns and a particle density of about 0.032 g/cc. Because of the low bulk density of the Saran microspheres, it is preferred that only from about 0.25 to about 1% by weight thereof be used in the water-in-oil emulsions of the subject invention.

Many of the closed cell, void containing, materials are somewhat costly. Accordingly, a lower cost means for generating gas bubbles, chemical gassing in situ, is frequently employed. Gas bubbles are generated in-situ by adding to the composition and distributing therein a gas-generating material such as, for example, an aqueous solution of sodium nitrite, often in combination with sodium thiocyanate or thiourea, to sensitize the explosive emulsions. Within minutes of mixing the components, nitrogen bubbles begin to form and the density of the emulsion is thus lowered.

Chemical gassing results in emulsion densities generally corresponding to the values obtained using closed cell void containing materials.

In order to obtain satisfactory chemical gassing and resultant reduction of density of the emulsion, it is generally necessary to reduce the pH of the emulsion, commonly accomplished by adding acidic materials to the composition.

The acid may be an organic acid or a mineral acid. Commonly used are acetic acid, often with a buffer such as sodium acetate, hydrochloric acid and the like.

Gas bubbles which are generated in-situ by adding to the composition and distributing therein a gas-generating material such as, for example, an aqueous solution of sodium nitrite, can also be used can be used to sensitize the explosive emulsions. Other suitable sensitizing components which may be employed alone or in addition to the foregoing include insoluble particulate solid self-explosives or fuel such as, for example, grained or flaked TNT, DNT, RDX and the like, aluminum, aluminum alloys, magnesium, silicon, ferrophosphorus and ferro-silicon; and water-soluble and/or hydrocarbon-soluble organic sensitizers such as, for example, amine nitrates, alkanolamine nitrates, hydroxyalkyl nitrates, and the like. The explosive emulsions of the present invention may be formulated for a wide range of applications. Any combination of sensitizing components may be selected in order to provide an explosive composition of virtully any desired density, weight-strength or critical diameter. The quantity of solid self-explosives or fuels and of water-soluble and/or hydrocarbon-soluble organic sensitizers may comprise up to about 50% by weight of the total explosive composition. The volume of the occluded gas component may comprise up to about 50% of the volume of the total explosive composition.

Supplemental Additives

Supplemental additives may be incorporated in the emulsions of the invention in order to further improve sensitivity, density, strength, rheology and cost of the final explosive. Typical of materials found useful as optional additives include, for example, particulate non-metal fuels such as sulfur, soft coal, gilsonite and the like; particulate inert materials such as sodium chloride, barium sulphate and the like; thickeners, used in thickening amounts, such as guar gum, polyacrylamide, carboxymethyl or ethyl cellulose, biopolymers, starches, elastomeric materials, and the like; crosslinkers for the thickeners such as potassium pyroantimonate and the like; buffers or pH controllers such as sodium borate, zinc nitrate and the like; crystals habit modifiers such as alkyl naphthalene sodium sulphonate and the like; liquid phase extenders such as formamide, ethylene glycol and the like; and bulking agents and additives of common use in the explosives art. The quantities of supplemental additives used may comprise up to about 50% by weight of the total explosive composition.

Co-emulsifier

A co-emulsifier is an auxiliary surfactant, typically having hydrophilic-lipophilic balance (HLB) ranging from about 1 to about 6. Any emulsifier which together with the succinic emulsifier composition serves to establish the requisite water in oil emulsion and is stable to the conditions under which the emulsion is formed, may be used in the present invention. Such emulsifiers generally consist of lipophilic and hydrophilic portions. From about 5% to about 50% by weight of co-emulsifier, based on total emulsifier content, may be used together with the emulsifier used in this invention. Co-emulsifiers are used, for example, to enhance emulsion stability.

The lipophilic portion of the co-emulsifier may be either monomeric or polymeric in nature. Examples of suitable chain structures include those described as hydrocarbyl groups of the polycarboxylic acids used to prepared the emulsifiers of this invention. These co-emulsifiers include the internal amine salts, ester salts, and the like which are well known in the art and which are mentioned in several of the patents referred to in the Background of the Invention of this patent application.

The following examples illustrate representative co-emulsifiers that may be used to prepare the emulsions of this invention.

Co-emulsifier 1

A reactor is charged with 1151 parts mineral oil (Naphthenic pale 40N, Diamond Shamrock) which is heated to 66° C. While maintaining this temperature, 1000 parts of the product of Example 13 are added and the materials are mixed thoroughly. Dimethylethanol amine (151 parts) is then added at such a rate that the batch temperature exotherms to 82° C. The batch is heated to 93° C. and is held at temperature for 2 hours. The batch is then filtered.

Co-emulsifier 2

A reactor is charged with 332 parts of the product of Example 13, 102.8 parts hexadecyl succinic anhydride and 323 parts mineral oil (Valvoline/Ashland 100N). The materials are stirred and heated to 95° C. whereupon 20 parts ethylene glycol are charged. The temperature is held at 95° C. for 4 hours. Dimethylaminoethanol (56.7 parts) is charged, the temperature is increased to 160° C. and is maintained for 6 hours. TAN=14.5, TBN=36, % N=0.95.

Other suitable co-emulsifiers include salts of hydrocarbyl group substituted succinic acylating agents, salts of partially esterifed hydrocarbyl group substituted poly-acids, sorbitan esters, such as sorbitan sesquioleate, sorbitan monooleate, sorbitan monopalmitate, the mono- and diglycerides of fat forming fatty acids, soybean lecithin and derivatives of lanolin such as isopropyl esters of lanolin fatty acids, mixtures of higher molecular weight fatty alcohols and wax esters, ethoxylated fatty ethers such as polyoxyethylene(4) lauryl ether, and oxazoline emulsifiers such as substituted oxazolines such as 2-oleyl-4-4'-bis(hydroxymethyl)-2-oxazoline and suitable mixtures thereof.

Method of Making the Emulsions

The emulsions of this invention may be prepared by mixing the emulsifier with the organic fuel then adding this mixture to the aqueous component.

A useful method for making the emulsions of the invention comprises the steps of (1) mixing water, inorganic oxidizer salts (e.g., ammonium nitrate, including prilled agricultural grade ammonium nitrate) and, in certain cases, some of the supplemental water-soluble compounds, in a first premix, (2) mixing the carbonaceous fuel, the emulsifier of the invention and any other optional oil-soluble compounds, in a second premix and (3) adding the first premix to the second premix in a suitable mixing apparatus, to form a water-in-oil emulsion. The first premix is heated until all the salts are completely dissolved and the solution may be filtered if needed in order to remove any insoluble residue. The second premix is also heated, if necessary, to liquefy the ingredients. Any type of apparatus capable of either low or high shear mixing can be used to prepare these water-in-oil emulsions. Closed-cell, void containing materials, gas-generating materials, solid self-explosive ingredients such as particulate TNT, particulate-solid oxygen-supplying salts such as additional agricultural grade ammonium nitrate prills and ANFO, solid fuels such as aluminum or sulfur, inert materials such as barytes or sodium chloride, undissolved solid oxidizer salts and other optional materials, if employed, are added to the emulsion and simply blended until homogeneously dispersed throughout the composition.

Employing emulsifiers other than those of the instant invention frequently results in reduced stability when additional agricultural grade ammonium nitrate prills are added to the emulsion.

The water-in-oil explosive emulsions of the invention can also be prepared by adding the second premix liquefied organic solution phase to the first premix hot aqueous solution phase with sufficient stirring to invert the phases. However, this method usually requires substantially more energy to obtain the desired dispersion than does the preferred reverse procedure. Alternatively, these water-in-oil explosive emulsions are particularly adaptable to preparation by a continuous mixing process where the two separately prepared liquid phases are pumped through a mixing device wherein they are combined and emulsified.

The emulsifiers of this invention can be used directly to prepare the inventive emulsions. They can also be diluted with a substantially inert, normally liquid organic diluent such as mineral oil, naphtha, benzene, toluene or xylene, to form an additive concentrate. These concentrates usually contain from about 10% to about 90% by weight of the emulsifier composition of this invention and may contain, in addition, one or more other additives known in the art or described hereinabove.

Examples I–II are directed to explosive emulsions. The procedure for malting these emulsions involves the following steps. Ammonium nitrate (753 parts) is mixed with 188.2 parts water, 2.36 parts $Zn(NO_3)_2$, 0.23 parts $Na_2CO_3$ and 1.8 parts Galoryl 725 (naphthalene sulfonate-formaldehyde condensation product) at 75° C. The emulsifier is mixed with diesel fuel oil, in the amounts indicated in Table I, at 60° C. The aqueous mixture is added to the diesel fuel oil and emulsifier mixture to form a plain water-in-oil emulsion. The plain emulsions are identified, as emulsions I-A and II-A. Employing these plain emulsions as a base, additional emulsions containing other additives are prepared by mixing these emulsions with the other additives. Emulsions containing plain emulsions I-A and II-A and each further containing 1% by weight aqueous gassing solution (15% sodium nitrite/30% sodium thiocyanate solution) are identified as emulsions I-B and II-B. Emulsions containing 70% plain emulsion and 30% added ammonium nitrate are identified as emulsions I-C and II-C. Emulsions 'C' having incorporated therein 1% of the gassing solution are identified as emulsions I-D and II-D. Each of these explosive emulsions is useful as a blasting agent.

TABLE I

| Example No. | I-A | II-A |
|---|---|---|
| Product of Ex. M | 16.67 | |
| Product of Ex. N | | 16.7 |
| #2 Diesel Fuel Oil | 37.3 | 37.3 |

It is known that some of the materials described above may interact in the final formulation, so that the components of the final formulation may be different from those that are initially added. For instance, metal ions can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Each of the documents referred to above is incorporated herein by reference. Except in the examples, or where otherwise explicitly indicated, all numerical quantities in this description specifying amounts of materials, reaction conditions, molecular weights, number of carbon atoms, and the like, are to be understood as modified by the word "about". Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A water-in-oil emulsion explosive composition comprising a) an aqueous oxidizer phase comprising at least one oxygen supplying component wherein said oxygen supplying component comprises at least 50% by weight of prilled agricultural grade ammonium nitrate consisting of ammonium nitrate and optional additives selected from the group consisting of crystal growth modifiers, ammonium sulfate, magnesium stearate, talc, clay, magnesium nitrates, aluminum sulfate, limestone, and polymeric sulfonates, b) an organic phase comprising at least one organic fuel, and c) an emulsifying amount of an aliphatic hydrocarbyl group substituted succinic emulsifier composition said succinic emulsifier composition characterized by comprising one or more groups selected from succinic ester groups, succinic amide groups, succinic imine groups, succinic amide-ester and succinimide groups, and mixtures thereof wherein at least one of said one or more groups includes a reaction product of a succinic group with an aminoalkyl group, wherein said aliphatic hydrocarbyl group contains from about 18 up to about 500 carbon atoms and wherein the total acid number divided by the total base number is 0.319 or less.

2. The composition according to claim 1, wherein said aliphatic hydrocarbyl group contains from about 30 to about 200 carbon atoms.

3. The composition according to claim 1, wherein said aliphatic hydrocarbyl group contains from about 50 to about 150 carbon atoms.

4. The composition of claim 1 wherein said aliphatic hydrocarbyl group is a polyisobutylene group.

5. The composition of claim 1 wherein said aliphatic hydrocarbyl group substituted succinic emulsifier composition comprises at least one succinic ester group.

6. The composition of claim 1 wherein said aliphatic hydrocarbyl group substituted succinic emulsifier comprises at least one succinic ester group and at least one succinic amide group.

7. The composition of claim 1 wherein each aliphatic hydrocarbyl group substituted succinic emulsifier comprises at least one succinic amide group.

8. The composition of claim 1 wherein said aliphatic hydrocarbyl group substituted succinic emulsifier comprises a succinimide group.

9. The composition of claim 1 wherein each aminoalkyl group has the general formula —$R^1$—N—$(R^2)_2$ wherein $R^1$ is a divalent lower hydrocarbylene group and each $R^2$ is, independently, H or a lower hydrocarbyl group.

10. The composition of claim 9 wherein $R^1$ is an alkylene group.

11. The composition of claim 1 wherein the aqueous oxidizer phase further comprises at least one member selected from the group consisting of alkali or alkaline earth metal nitrates, chlorates and perchlorates.

12. The composition of claim 1 wherein said continuous organic phase comprises a carbonaceous fuel that is a water-immiscible, emulsifiable hydrocarbon that is either liquid at about 20° C. or liquefiable at a temperature below about 95° C.

13. The composition of claim 12 wherein the carbonaceous fuel comprises at least one member of the group consisting of diesel oil, mineral oil, vegetable oil and hydrocarbon wax.

14. The composition of claim 1 wherein the continuous organic phase is present in amounts ranging from about 2% to about 10% by weight, the discontinuous aqueous phase is present in amounts ranging from about 90% to about 98% by weight, both based on the total weight of the emulsion composition, said oxygen-supplying component is present at a level in the range of about 70% to about 95% by weight based on the weight of said aqueous phase, and the emulsifier composition is present in amounts ranging from about 4% to about 40% by weight based on the total weight of the oil phase.

15. The composition of claim 1 wherein at least about 90% by weight of said oxygen-supplying component is said prilled agricultural grade ammonium nitrate.

16. The composition of claim 1 further comprising a sensitizing amount of at least one closed-cell, void-containing material.

17. The composition of claim 1 wherein said emulsion contains up to about 90% by weight of a preblended ammonium nitrate-fuel oil mixture.

18. The composition of claim 1 further comprising up to about 50% by weight of a particulate solid fuel.

19. The composition of claim 17 wherein the particulate solid fuel is selected from the group consisting of aluminum, aluminum alloys, magnesium, silicon, ferrophosphorus and ferro-silicon.

20. The composition of claim 5 wherein each aminoalkyl group has the general formula $R^1$—N—$(R^2)$—$R^3$ where $R^1$, $R^2$, and $R^3$ are the same or different hydrocarbyl groups of 1 to 20 carbon atoms.

* * * * *